United States Patent [19]

Hanaya

[11] 4,161,972

[45] Jul. 24, 1979

[54] APPARATUS FOR PRODUCING CHIPS FROM LOGS OF TIMBER

[75] Inventor: Morimasa Hanaya, Kure, Japan

[73] Assignee: Toyo Pulp Co., Ltd., Tokyo, Japan

[21] Appl. No.: 645,863

[22] Filed: Dec. 31, 1975

[30] Foreign Application Priority Data

| | | | |
|---|---|---|---|
| Jan. 8, 1975 | [JP] | Japan | 50-4479 |
| Feb. 23, 1975 | [JP] | Japan | 50-75506 |
| Feb. 28, 1975 | [JP] | Japan | 50-23847 |
| May 15, 1975 | [JP] | Japan | 50-56751 |
| Aug. 26, 1975 | [JP] | Japan | 50-102588 |

[51] Int. Cl.[2] ..... B27C 1/60

[52] U.S. Cl. ..... 144/176; 144/162 R; 144/218; 144/323; 144/241; 407/48; 407/61; 407/115

[58] Field of Search ..... 144/162, 172, 174, 176, 144/218, 231, 234, 230, 235, 326 A, 326 B, 326 C, 323, 240, 241; 241/92, 93, 222, 297, 292.1; 407/48, 61, 103, 115

[56] References Cited

U.S. PATENT DOCUMENTS

| | | | |
|---|---|---|---|
| 3,304,970 | 2/1967 | Altosaar | 144/176 X |
| 3,308,862 | 3/1967 | Traben | 144/326 B |
| 3,330,315 | 7/1967 | Tomlinson | 144/162 R |
| 3,486,211 | 12/1969 | Greenleaf | 407/48 |
| 3,746,062 | 7/1973 | Nystrom et al. | 144/176 |
| 3,875,984 | 4/1975 | Plough | 144/162 R |

*Primary Examiner*—Donald R. Schran
*Assistant Examiner*—W. D. Bray
*Attorney, Agent, or Firm*—Frank J. Jordan

[57] ABSTRACT

A chipping device including a disc-like member having a front face and the opposite face connected at its central region to a rotating shaft, said front face being provided with a spiral working surface which consists of main and auxiliary oblique surface portions extending along a spiral path from the central region of said disc-like member to the peripheral edge thereof, and being inclined relative to a plane perpendicular to the rotational axis of the disc-like member with an angle included between said main and auxiliary surface portions, said working surface having a plurality of cutting blades spaced from one another therealong, each of said cutting blades having main and auxiliary cutting edges substantially parallel to said main and auxiliary oblique surface portions, respectively.

20 Claims, 49 Drawing Figures

APPARATUS FOR PRODUCING CHIPS FROM LOGS OF TIMBER

BACKGROUND OF THE INVENTION

1. Field of the Invention:

The present invention relates to an apparatus for producing chips from logs of timber.

2. Description of the Prior Art:

Chippers of drum type are generally known in the art. Such chippers are disclosed in Japanese Patent Publication Nos. 21120/1967, 26321/1968 and 7081/1974, for example. Each of the chippers of this type includes a drum having a hollow portion formed therein which receives chips cut out. These chips tend to cling to the inner periphery of the drum under the influence of centrifugal force when the drum is rotated so that they will be difficult to remove out of the drum. In view of such circumstances, the drums in the chippers must be rotated at extremely low speed, for example at 25 to 120 rpm. This means that the productivity thereof is restrained. Furthermore, the chippers of drum type have to use logs of timber having a constant length.

A chipper having frusto-conical cutting tools is also well known in the art. Each of the frusto-conical tools includes a frusto-conical body having a plurality of cutting blades disposed on the outer peripheral surface thereof along a spiral path. Two of such cutting tools are located on the opposite sides of a log of timber to be chipped. Chippers of this type are disclosed in Japanese Patent Publication Nos. 15563/1968 and 24479/1973, for example. Each of these disclosed chippers is intended to produce square lumbers as well as chips from logs of timber. They are not designed to chip a whole log of timber.

Japanese Patent Publication No. 15562/1968 discloses a chipper consisting of a frusto-conical drum which is provided with a plurality of cutting blades disposed on the peripheral surface thereof along a spiral path. In such a chipper, a log of timber is fed axially at a fixed angle relative to the frusto-conical drum to produce chips cut out parallel to the fibre direction of the timber. In order to avoid that the interior of the drum receives the chips, the chipper is provided with a pocket adjacent to each of the cutting blades. Therefore, this chipper cannot obtain chips having uniform shape and size because of the hollow space created therein. Moreover, the frusto-conical drum is difficult to manufacture and also very costly.

Chips, particularly for cellulose pulp woods or fiberboards, are required to be of uniform size and subjected to no damage in any wood fibre thereof. None of the inventions disclosed in the abovementioned Japanese patent publications satisfies these requirements.

SUMMARY OF THE INVENTION

It is an object of the present invention to provide a chipper having a simple structure which can more effectively and rapidly produce chips from logs of timber.

Another object of the present invention is to provide a chipper for obtaining uniformly sized chips having undamaged wood fibres thereof by cutting logs of timber parallel to the wood fibre direction thereof.

Still another object of the present invention is to provide a chipper which can be more easily manufactured and more simply maintained.

Other objects and features of the present invention will be apparent from the following description in connection with the accompanying drawings throughout which the same reference numerals indicate the same components.

BRIEF DESCRIPTION OF THE DRAWING

With reference to the accompanying drawing.

DESCRIPTION OF THE PREFERRED EMBODIMENT

Figure 1:
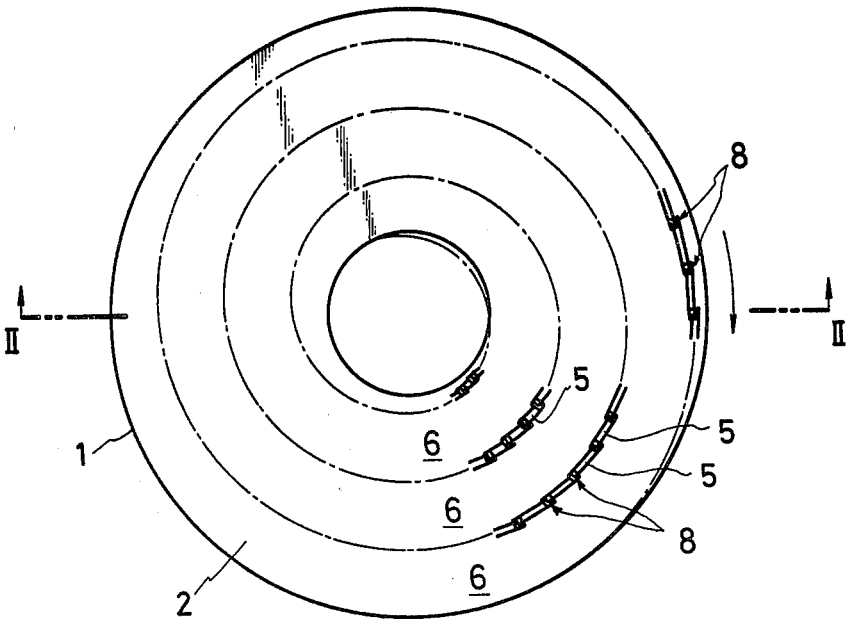
FIG. 1 is a plan view showing a disc-like member used in the present invention.
Figure 2:
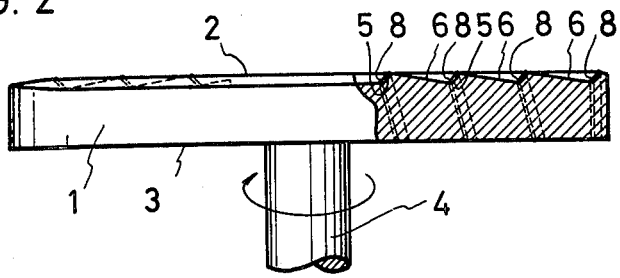
FIG. 2 is a side view of the disc-like member shown in FIG. 1, illustrating a partial section taken along the line II—II in FIG. 1.
Figure 3:
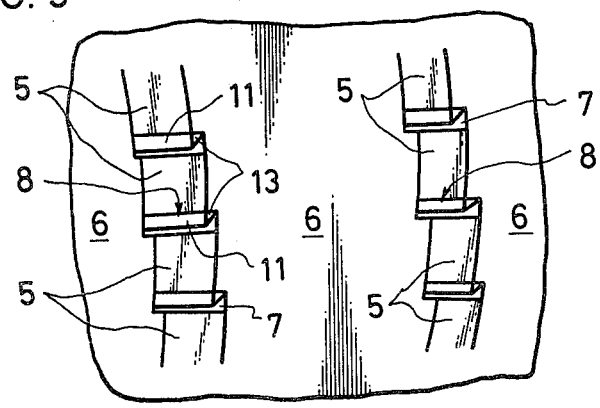
FIG. 3 is an enlarged view of part of FIG. 1, illustrating cutting blades disposed on the disc-like member.

Referring to FIGS. 1 to 3, a chipper according to the present invention includes a disc-like member 1 which has opposite faces 2 and 3 which are substantially flat. The back face 3 of the disc-like member 1 is connected at its central region to a rotating shaft 4 which is driven by any suitable driving means (not shown). It is not necessary that this back face 3 is always flat.

The front face 2 of the disc 1 is provided with a spiral working surface extending along a spiral path from the central region of the front face 2 to a point on the peripheral edge thereof. The working surface consists of main and auxiliary oblique surface portions 5 and 6 respectively inclined downwardly from a plane perpendicular to the axis of the shaft 4 and including the front face 2 with an angle included therebetween.

In the embodiment shown in FIGS. 1 and 3 the main oblique surface portion 5 constitutes intermittent curved oblique surface positions. However, as will be described in greater detail hereinafter in the embodiment shown in FIGS. 8 and 11 the main oblique surface portion 5 may be a spirally continuous oblique surface plane.

Figure 4:
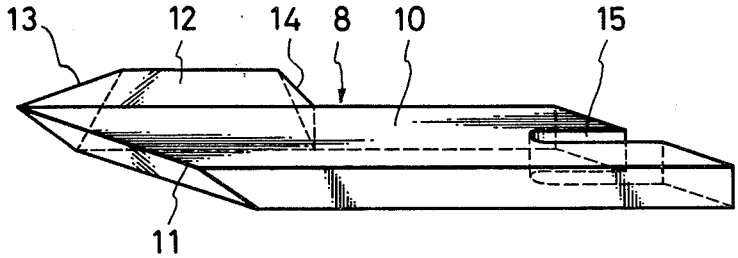
FIG. 4 is an enlarged perspective view showing one of the cutting blades mounted on the disc-like member of FIG. 1.

The working surface is provided with a plurality of openings 7 extending over and through the main and auxiliary oblique surface portions 5 and 6. The openings 7 are spaced from one another along the spiral path. Each of the openings 7 receives a cutting blade 8 as shown in FIG. 4. The cutting blade 8 includes a rectangular plate-like body 10 which is formed at its one end with a main cutting edge 11 extending obliquely relative to the longitudinal axis of the body 10. The body 10 is provided with a side piece 12 formed integrally with one side thereof and which extends obliquely outward of the body 10. The side piece 12 has an auxiliary cutting edge 13 formed therein with an angle included between the main and auxiliary cutting edges 11 and 13. The side piece 12 also has a slanted rear edge 14 as shown in FIG. 4. The angle included between the main and auxiliary cutting edges substantially corresponds to that angle included between the main and auxiliary oblique surface portions 5 and 6 of the disc-like member 1.

Figure 6:
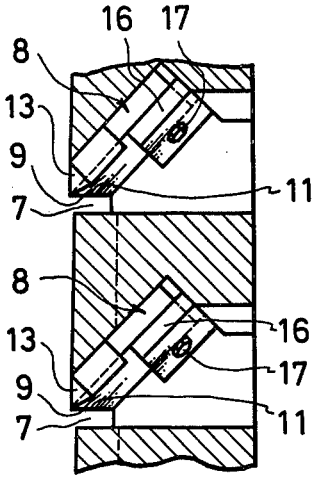
FIG. 6 is a partial view showing in section the disc with the cutting blades mounted thereof.

Each of the cutting blades 8 has a slot 15, formed therein at the opposite end for mounting it in the respective opening 7 of the disc 1. The cutting blade 8, as seen best from FIG. 6, is mounted within the opening 7 by means of a screw 17 which passes through the slot 15 and a keep plate 16. The opening 7 has an edge adjacent to the cutting blade 8 in a position higher than the opposite edge thereof with respect to the spiral path. The main and auxiliary cutting edges 11 and 13 of the cutting blade 8 are positioned flush with the raised edge of the opening 7. The difference between the edges of the opening 7, that is, an amount that the cutting edges protrude beyond the edges of the opening corresponds to the thickness of timber material to be cut out.

In this illustrated embodiment of the present invention, a connection between the main and auxiliary cutting edges 11 and 13 of each blade 8 has a relatively high strength since the auxiliary cutting edge 13 is formed in the side piece 12 having a relatively large length along the side of the body 10.

Figure 7:
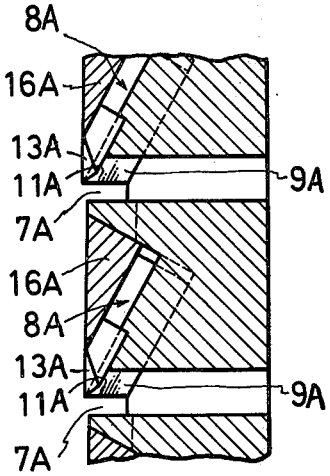
FIG. 7 is a view similar to FIG. 6, illustrating another manner in which the cutting blades are mounted on the disc.

FIG. 7 illustrates cutting blades 8A mounted adjacent to the openings in a manner different from that of FIG. 6. Each of the cutting blades 8A is mounted in the side of the working surface on the disc-like member 1 by means of a keep plate 16A. The cutting edges of the blade 8A protrude slightly outwardly of the edge of an opening 7A. The keep plate 16A forms part of the working surface in the disc-like member 1. In this arrangement, the opening 7A has a shape different from the opening 7 in FIG. 6. Furthermore, in FIG. 7, it is necessary to modify the cutting edges of the blade 8A relative to the blade 8 of FIG. 4 since the blade 8A is mounted on the disc 1A with an angle smaller than that of FIG. 6. Further, it is desirable in the quality of chips that the opening 7 or 7A is of a thickness equal to that of a chip cut out by the cutting blade 8 or 8A respectively. However, the thickness of the opening may be increased slightly in order to decrease a cutting resistance when the chip is being cut out.

Figure 5:
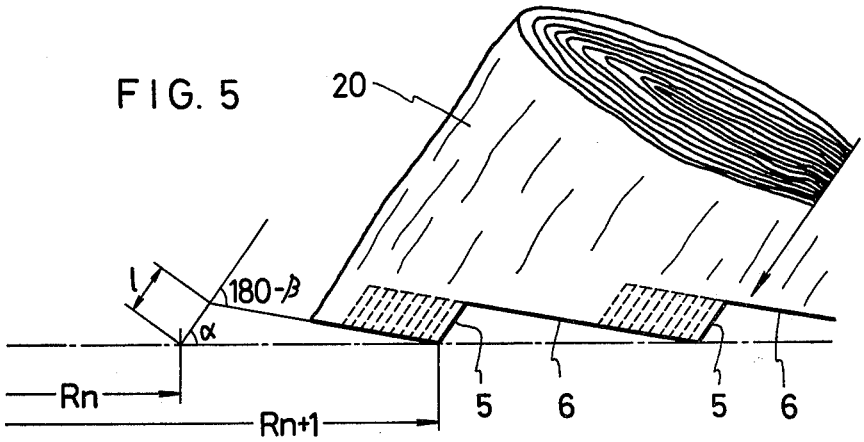
FIG. 5 is a schematic view illustrating a direction of moving in which a log of timber is fed to the chipper as well as the action of the cutting blades.

In the operation of the chipper which has been described hereinbefore, a log of timber 20 is fed to a half face portion of the front face 2 of the disc-like member 1 from the peripheral edge thereof in a direction inclined outwardly relative to the rotational axis of the disc 1 as shown in FIG. 5. When the disc-like member 1 is rotated in a direction shown by an arrow in FIG. 1, the main cutting edge 11 first penetrates the log of timber in a direction parallel to the wood fibre thereof and then the auxiliary cutting edge 13 shears the log in timber in a direction transverse to the direction of wood fibre.

In such a manner, strips of wood will be cut out of the log of timber with its width corresponding to the length of the main cutting edge 11 and with its thickness corresponding to the quantity that the main cutting edge 11 protrudes. These strips of wood are bent sharply as they pass through the opening 7 or 7A so that they will be formed into a plurality of chips having parallelograms cross section with cracks produced along the grain of the log.

Figure 8:
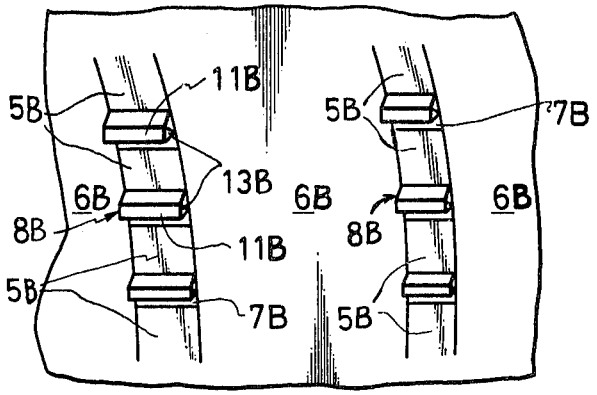
FIG. 8 is a view similar to FIG. 3, illustrating a disposition of cutting blades in another embodiment of the present invention.
Figure 9:
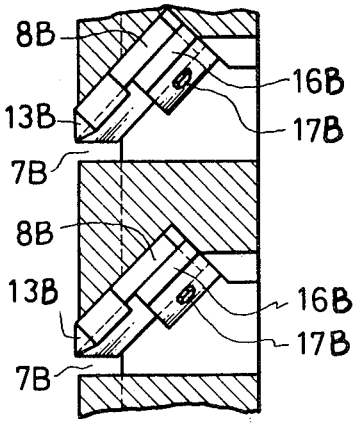
FIG. 9 is a view similar to FIG. 6, illustrating a manner in which the cutting blades in FIG. 8 are mounted on the disc-like member.

FIGS. 8 and 9 show another embodiment of the present invention which uses the same cutting blades as that in the previous embodiment but is different in that each opening is shaped in a different manner in that the main oblique surface portion 5B constitutes a spirally continuous oblique surface plane. In this embodiment, the respective opening 7B of the disc-like member has a front and rear edge positioned in the same plane. Each of the cutting blades 8B is mounted within the opening 7B by means of the keep plate 16B and the screw 17B such that the main and auxiliary cutting edges thereof protrude slightly outward of the opening 7B between the edges thereof.

Figure 10:
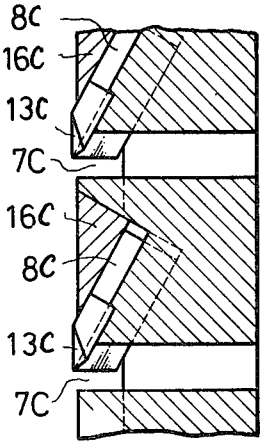
FIG. 10 is a view similar to FIG. 7, illustrating a blade-mounting manner different from that of FIG. 9.

FIG. 10 illustrates the cutting blades 8C mounted within the opening 7C in a manner different from that of FIG. 9. Each of the cutting blades 8C similarly protrudes outwardly of the opening 7C beyond the front and rear edges thereof, and is mounted on the disc-like member 1C in the side of the spiral working surface thereof by means of the keep plate 16C. In this case, it is necessary, similarly as in the previous embodiment shown in FIG. 7, to modify the cutting edges of the plate 8C.

It is apparent that since the chippers according to the present invention can be operated at higher speed, for example, about 700 to 900 rpm, compared with a conventional chipper of drum type, the productivity can be increased; and yet superior chips having uniform size can be obtained by cutting logs of timber in a direction parallel to the wood fibre thereof. Further, it should be understood that the function as described with respect to the cutting blade 8 is similarly performed in all of the cutting blades disposed on the spiral working surface of the disc-like member.

Figure 11:
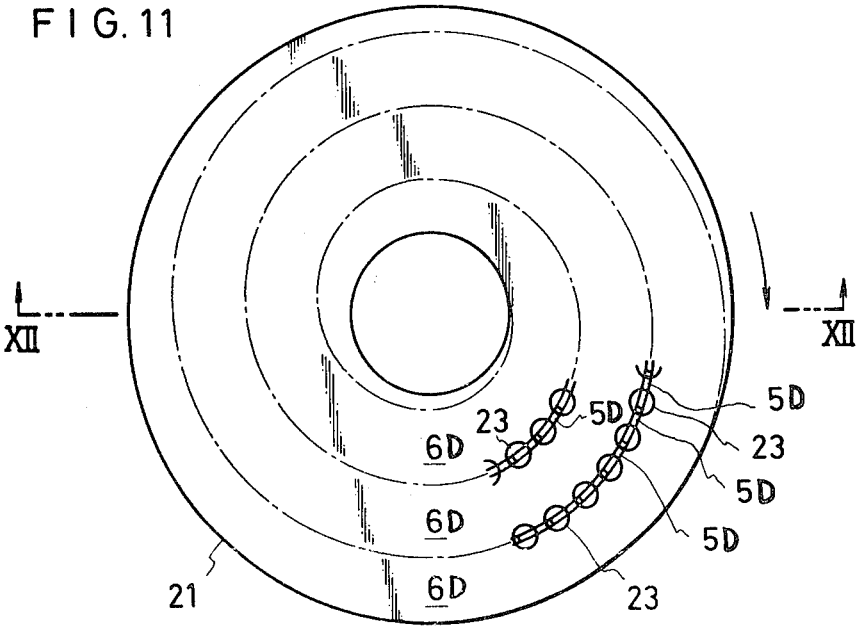
FIG. 11 is a plan view showing a disc-like member in a further embodiment of the present invention.
Figure 12:
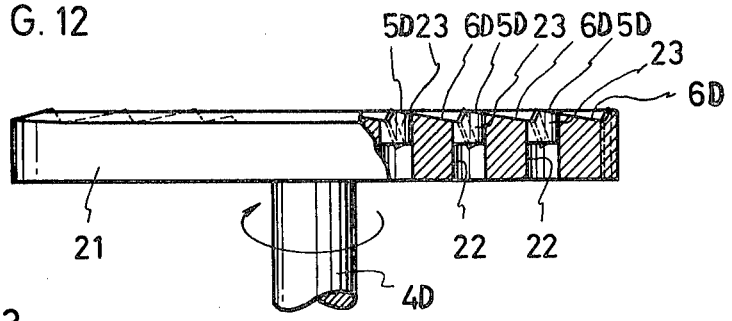
FIG. 12 is a side view of FIG. 11 showing partially a cross section taken along line XII—XII in FIG. 11.
Figure 13:
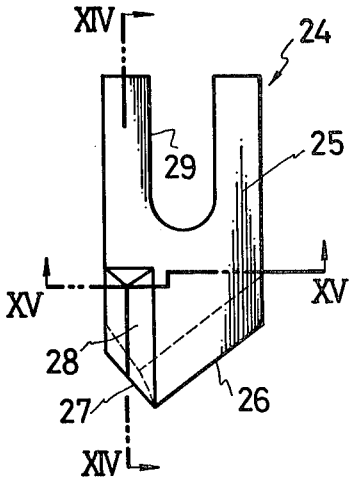
FIGS. 13 to 17 are views showing in various directions a cutting blade which can be used in the further embodiment shown in FIG. 11.
Figure 14:
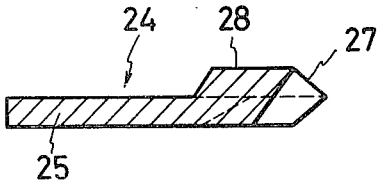
Figure 15:
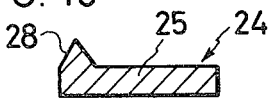
Figure 16:
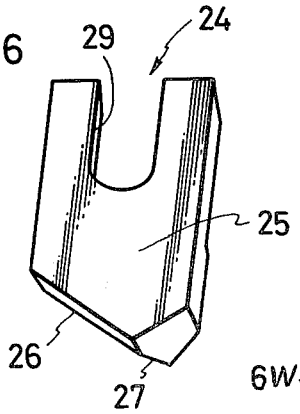
Figure 17:
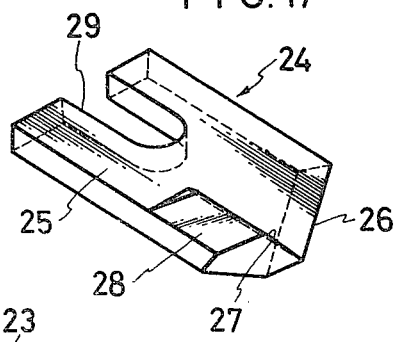
Figure 18:
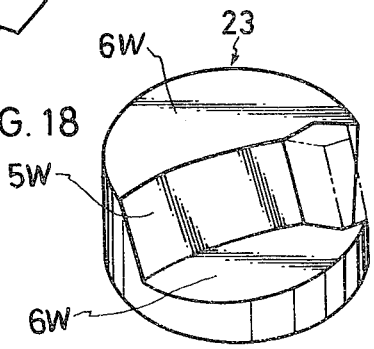
FIGS. 18 to 25 are views showing in various directions a blade-mounting member for mounting the cutting blades shown in FIGS. 13 to 17 on the disc-like member.
Figure 19:
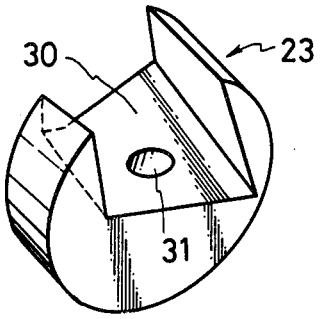
Figure 22:
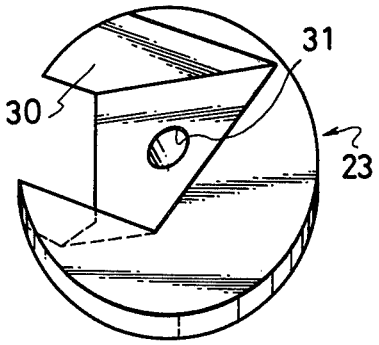

FIGS. 11 and 12 show still another embodiment of the present invention in which the spiral working surface of the disc-like member 21 is provided with a plurality of circular openings 22 spaced from one another and extending over and through main and auxiliary oblique surface portions 5D and 6D. The openings 22 are adapted to receive blade-mounting members 23, respectively. The members 23 can be firmly secured within the respective openings 22 by any suitable means. The blade mounting members 23 will hereinafter be described in connection with FIGS. 18 to 25.

FIGS. 13 to 17 illustrate a cutting blade 24 which can be supported by the blade-mounting member 23. The cutting blade 24 includes a rectangular plate-like body 25 which has one end formed with main and auxiliary cutting edges 26 and 27 disposed angularly to each other. The auxiliary cutting edge 27 is formed in the body 25 at a land 28 formed on one surface thereof. The angle included between the main and auxiliary cutting edges 26 and 27 substantially corresponds to that between the main and auxiliary oblique surface portions 5D and 6D of the disc-like member 21. The cutting blade 24 has the main and auxiliary cutting edges 26 and 27 formed in a single body 25 as in the previous embodiment and yet includes the land 28 serving to reinforce the body 25. Therefore, this cutting blade 24 is also improved in its durability. The body 25 has the opposite end formed with a slot 29 for mounting the cutting blade on the blade-mounting member.

Figure 20:
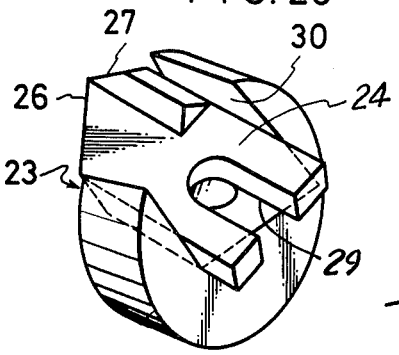
Figure 21:
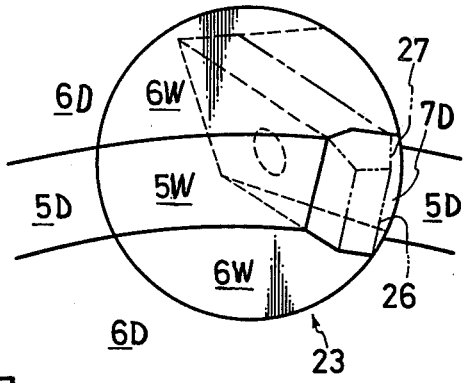
Figure 23:
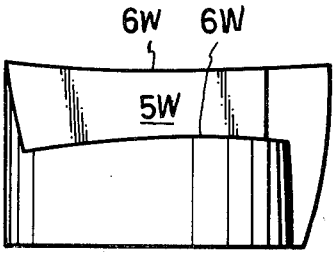
Figure 24:
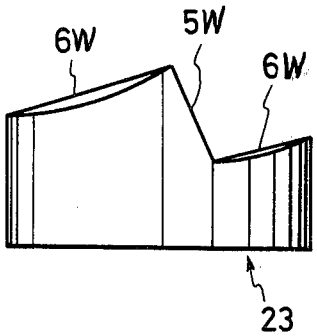
Figure 25:
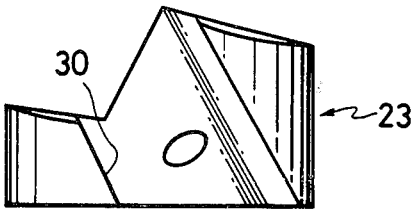

As seen best from FIG. 20, the cutting blade 24 is received within a groove 30 formed in one side of the member 23. The slot 29 in the cutting blade 24 must be aligned with a threaded aperture 31 in the groove 30. In such a manner, the cutting blade 24 is positioned such that the main and auxiliary cutting edges 26 and 27 thereof protrude above and substantially parallel to oblique surfaces 5W and 6W in the blade-mounting member 23, respectively. The oblique surfaces 5W and 6W are positioned in alignment with the corresponding oblique surface portions 5D and 6D of the disc-like member 21 when the blade-mounting member 23 is located within the opening 22 thereof. When each blade-mounting member 23 is located and firmly secured within the opening 22 in the disc-like member 21 with the oblique surfaces 5W and 6W being aligned with the corresponding surface portions 5D and 6D of the member 21, the disc-like member 21 then has a predetermined number of cutting blades 24 disposed thereon along the spiral path and spaced from one another as in the previous embodiment. It should be understood that the cutting blade can be easily mounted on the disc-like member. Any suitable means can be used to attach the cutting blade 24 to the blade-mounting member 23.

Figure 26:
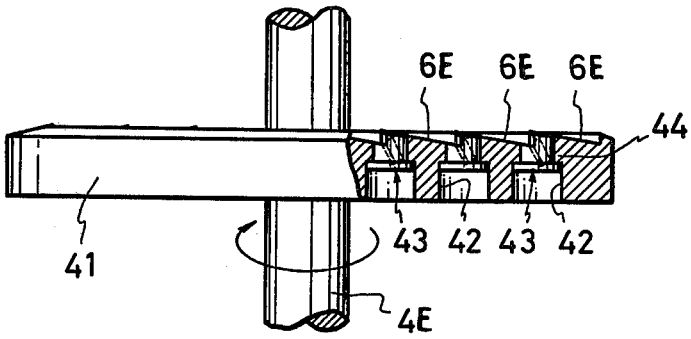
FIG. 26 is a view similar to FIG. 2 showing a still further embodiment of the present invention.
Figure 27:
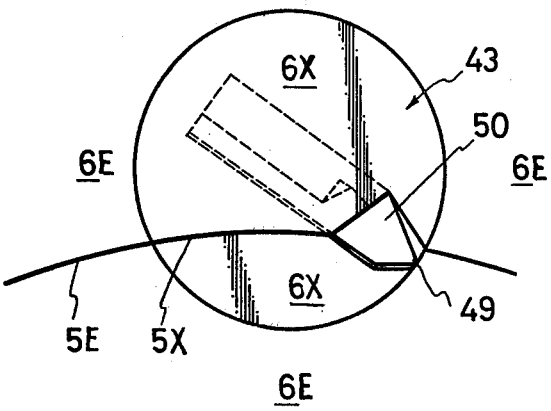
FIG. 27 is an enlarged plan view of part of the disc-like member in FIG. 26, showing one of the cutting blades used herein.
Figure 28:
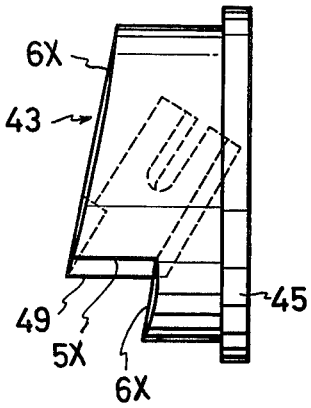
FIG. 28 is a side view of a blade-mounting used in the embodiment of the present invention shown in FIG. 26.

FIG. 26 indicates a further embodiment of the present invention in which the main oblique surface portion of the spiral working surface is parallel to the rotational axis of a disc-like member 41. The member 41 includes a number of openings 42 extending over and through the main and auxiliary oblique surface portions and spaced from one another along the spiral working surface. Each of the blade-mounting members 43 is received within the respective opening 42.

Figure 29:
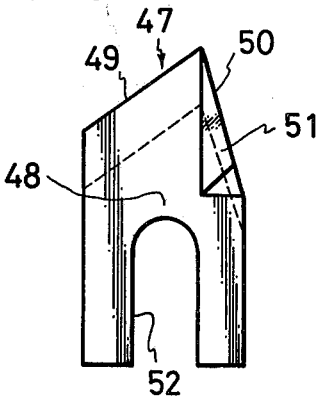
FIGS. 29 and 30 are views illustrating a cutting blade used in the embodiment of FIG. 26.
Figure 30:
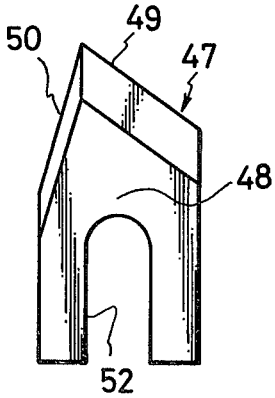

As shown in FIG. 26, the blade-mounting member 43 includes a flange 45 engaged by a shoulder 44 in the opening 42, and oblique surfaces 5X and 6X formed therein to be aligned with the respective oblique surface portions 5E and 6E of the disc-like member 41 when mounted. The blade-mounting member 43 also has, as seen best from FIG. 32, an oblique groove 46 formed at one side thereof, within which a cutting blade 47 shown in FIGS. 29 and 30 is received. The cutting blade 47 includes a rectangular plate-like body 48 which has main and auxiliary cutting edges 49 and 50 formed at one end thereof and positioned with an angle included therebetween. The auxiliary cutting edge 50 is formed at the front margin of the land 51 on one surface of the body 48. The cutting blade 47 has a slot 52 formed at the other end of the body 48 for mounting it on the disc-like member 41.

Figure 32:
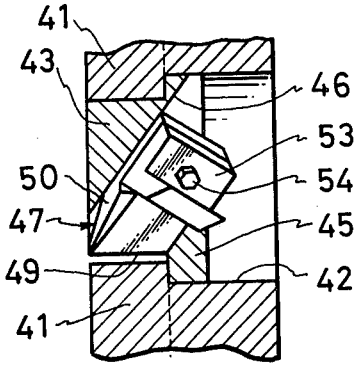
FIG. 32 is a partially cross sectional view illustrating an assembly of the cutting blade and mounting member mounted on the disc-like member in FIG. 26.
Figure 33:
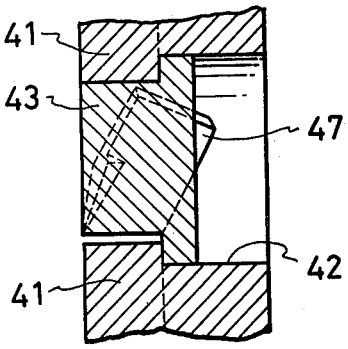
FIG. 33 illustrates a mounting member of the cutting blade different from that of FIG. 32.
Figure 34:
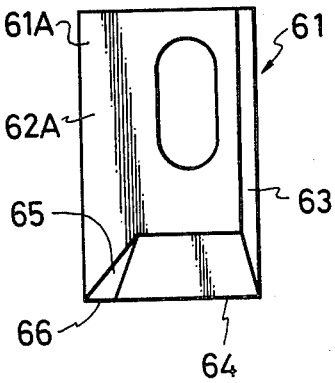
FIGS. 34 to 38 are views illustrating a modified cutting blade according to the present invention.
Figure 35:
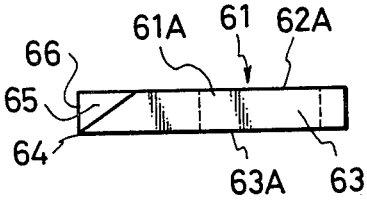
Figure 36:
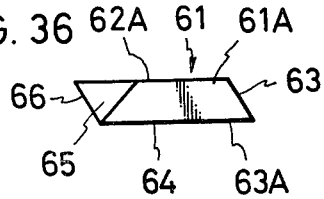
Figure 37:
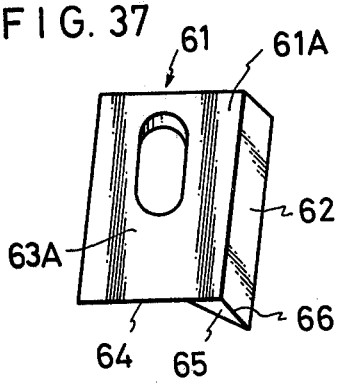
Figure 38:
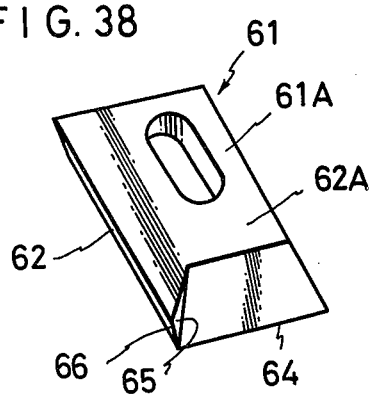
Figure 39:
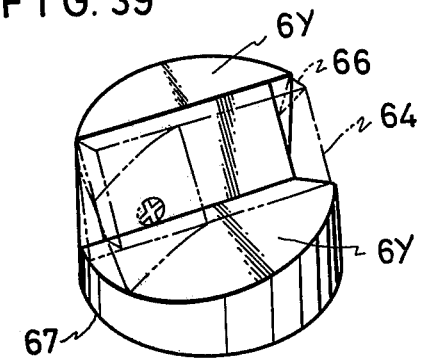
FIGS. 39 to 46 are views illustrating a blade-mounting member for mounting the cutting blade shown in FIGS. 34 to 38 on the disc-like member.
Figure 40:
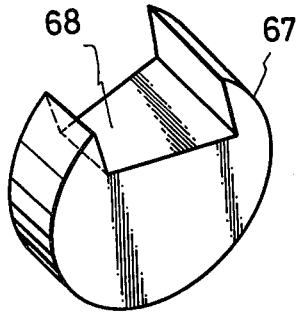
Figure 41:
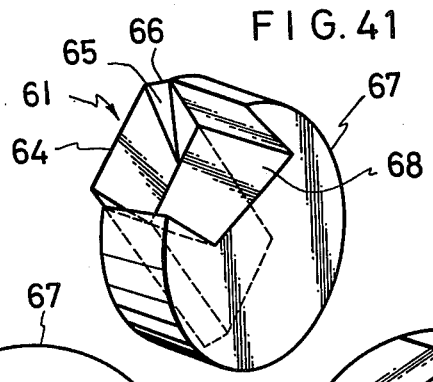
Figure 42:
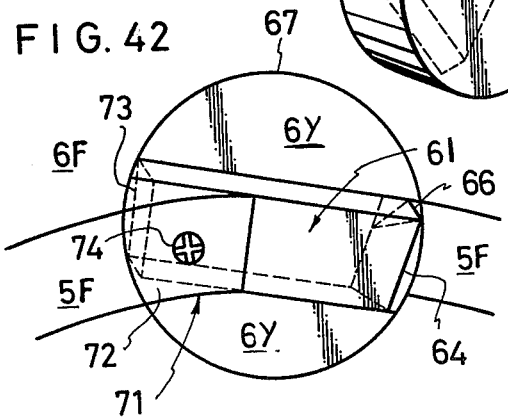
Figure 43:
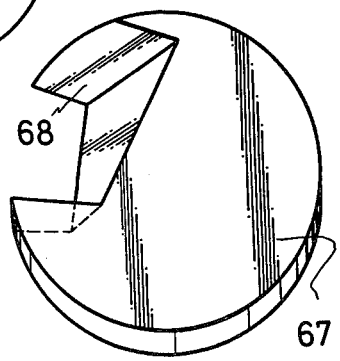
Figure 44:
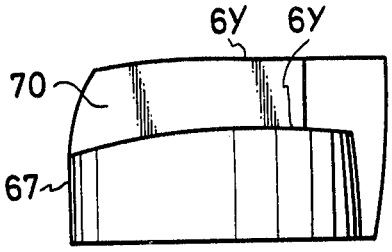
Figure 45:
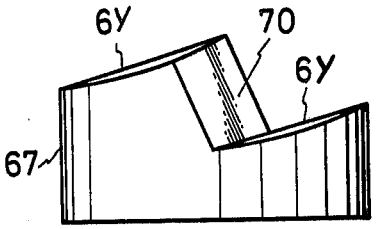
Figure 46:
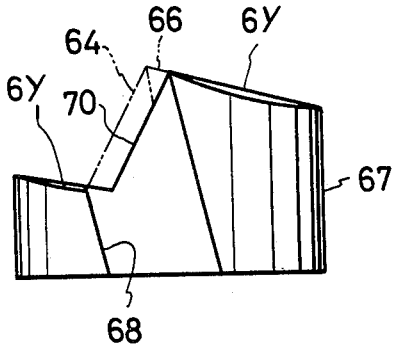

The cutting blade 47, as shown in FIGS. 32 and 33, is mounted within the groove 46 of the member 43 by means of a keep plate 53 and a screw 54. The main and auxiliary cutting edges 49 and 50 of the cutting blade 47 are positioned to protrude above and substantially parallel to the respective oblique surfaces 5X and 6X of the blade-mounting member 43. The blade-mounting member 43 on which the cutting blade 47 is mounted is inserted into the opening 42 in the disc-like member 41 and firmly secured by any suitable means.

Figure 31:
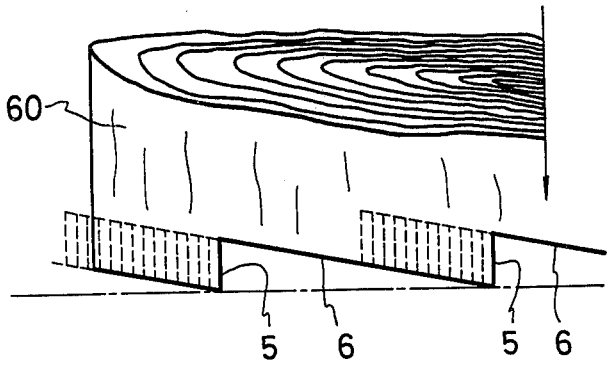
FIG. 31 illustrates a direction in which a log is fed to the disc-like member as well as the action of the cutting blades in the embodiment of FIG. 26.

In such an arrangement, a log of timber 60 is, as shown in FIG. 31, fed to the disc-like member 41 parallel to the rotational axis thereof. However, the log of timber 60 is similarly cut out into chips in a direction substantially parallel to the wood fiber thereof.

According to the present invention, it is also possible to use a cutting blade 61 shown in FIGS. 34 to 38. The cutting blade 61 includes a rectangular plate-like body 61A which has top and bottom surfaces 62A and 63A opposed parallel to each other and side surfaces 62 and 63 positioned to each other as seen best from FIG. 36. The body 61A has one end cut obliquely to form main cutting edge 64 and at the same time cut upward and outward at one side thereof to form an inclined surface 65. The front margin of the inclined surface 65 is provided with an auxiliary cutting edge 66 positioned angularly with the main cutting edge 64.

The cutting blade 61 is mounted on a blade-mounting member 67 shown in FIGS. 39 to 46, which is inserted into the opening in the disc-like member in the same manner as in the previous embodiments of the present invention. The blade-mounting member 67 includes a groove 68 formed at one side thereof, and a surface 6Y being adapted to be positioned in alignment with the auxiliary oblique surface portion 6F of the disc-like member when mounted. That portion of the blade-mounting member 67 corresponding to the main oblique surface portion 5Y of the disc-like member is provided with a recess 70 for receiving the cutting blade. The cutting blade 61 is received within the recess 70 such that the bottom 63A thereof provides an oblique surface of the member 67 corresponding to the main oblique surface portion 5F of the disc-like member. The cutting blade 61 is firmly secured to the recess 70 by means of a keep plate 71. The keep plate 71 is provided with surfaces 72 and 73 aligned with the respective oblique surface portions 5 and 6 of the disc-like member when the member 67 is mounted within the opening thereof.

The keep plate 71 is firmly secured to the blade-mounting member 67 by means of a screw 74. In such a manner, the blade mounting member 67 then has its surface corresponding to the main oblique surface portion 5F of the disc-like member, which surface is composed of the back 64 of the cutting blade 61 and the surface 72 of the keep plate 71.

It is apparent from the immediately above description that there will be obtained a spiral row of cutting blades 61 each of which has main and auxiliary cutting edges 64 and 66 positioned to protrude above and parallel to the respective oblique surface portions 5F and 6F of the disc-like member. In this embodiment, strips of wood which are cut out from a log of timber are passed through each of the openings of the disc-like member via the groove 68 of the blade-mounting member 67.

Figure 47:
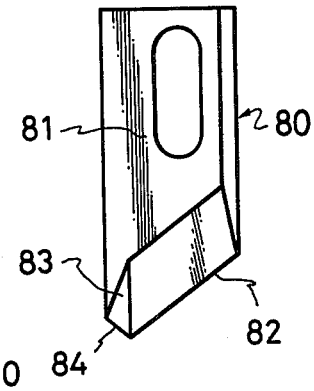
FIG. 47 is a plan view showing another modified cutting blade according to the present invention.
Figure 49:
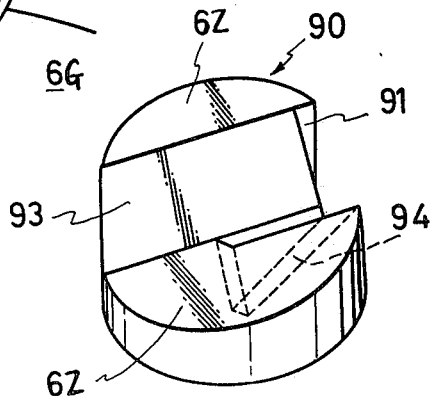

FIG. 47 shows a modified cutting blade from that in FIGS. 34 to 38. This modified cutting blade 80 includes a rectangular plate-like body 81 having main and auxiliary cutting edges 82 and 84 formed therein with an angle included therebetween which is different from that of FIGS. 34 to 38. The cutting blade 80 is adapted to be supported on a blade-mounting member 90 shown in FIG. 49.

Figure 48:
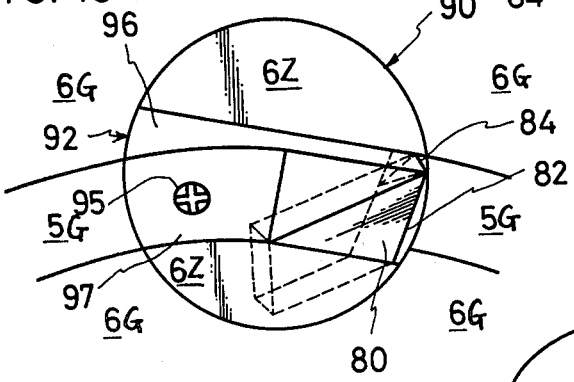
FIG. 48 illustrates a manner that the cutting blade of FIG. 47 is mounted on the disc-like member; and, FIG. 49 is a perspective view showing a blade-mounting member for mounting the cutting blade in FIG. 47 on the disc-like member.

The blade-mounting member 90 has a groove 91 formed in one side thereof which constitutes a passage for strips of wood cut out. The member 90 is similarly provided with surfaces 6Z corresponding to the auxiliary oblique surface portion 5G of the disc-like member. A recess 93 is formed in the member 90 between these surfaces 6Z for receiving a keep plate 92. A groove 94 is opened in the recess 93 for receiving a cutting blade 80. As shown in FIG. 48, the cutting blade 80 is mounted within the groove 94 and firmly secured thereto by means of the keep plate 92 and the screw 95.

The keep plate 92 includes surfaces 96 and 97 which substantially correspond to the respective one of the main and auxiliary oblique surface portions 5G and 6G when the blade-mounting member 90 is positioned within the opening in the disc-like member. When the member 90 is inserted into and fixed to the opening in the disc-like member, that surface of the member 90 corresponding to the main oblique surface portion 5G thereof will be defined by the bottom of the cutting blade 80 and the surface 97 of the keep plate 92.

Although some preferred embodiments of the present invention have been described hereinbefore, various modifications or changes can be made within the scope of the invention defined by the appending claims. Supposing that a letter $\alpha$ represents an angle of the main cutting edge relative to a plate perpendicular to the rotational axis of the disc-like member, and a letter "t" is a depth of the cutting blade which penetrates into the timber, that is, a height of the main cutting edge thereof which protrudes above the main oblique surface portion of the disc-like member, a variation of radial distance between the cutting blades can be calculated by the following formula:

$$R_n+1-R_n=(t\times n)/(\sin\alpha)$$

wherein $R_n+1$ is a distance from one of the cutting blades to the center of the disc-like member, $R_n$ is a distance from another blade aligned radially with said one blade in a direction toward the center of the disc-like member to this center and, "n" is the number of cutting blades on the same spiral working surface over an angle of 360 degrees.

Suppposing that $\beta$ is an angle included between the main and auxiliary cutting edges, "1" is the length of the main cutting edge, "Z" is the number of row of the spiral working surface provided with the cutting blades, and "N" is a rotational frequency of the disc-like member, a velocity "V" of the chipper which penetrates into a log of timber is calculated by the following formula:

$$V=N\times Z\times 1$$

$$V=N\times t\times n\ [\cot\alpha-\cot(180-\beta)]$$

It is apparent from the above formula that the chipper according to the present invention can be provided with multiple rows of the spiral working surface on the disc-like member, each of which has a plurality of cutting blades. In this case, a velocity of the chipper which penetrates into the log of timber is directly proportional to the number of the spiral working surface row.

When the disc-like member is of relatively large size, it may be divided into some sections so that the sections will be separately machined and then assembled into a single unit.

The main and auxiliary oblique surface portions constituting the spiral working surface may be reversed in respect to each other. Namely, the working surface may be reversely formed to locate the main surface portion 5 outside thereof and the auxiliary surface portion 6 inside thereof in a relationship reversed from that in FIG. 2. In this case, the disc-like member is reversely rotated, and a log of timber is fed in a direction inclined reversely, that is in a direction inclined from left-hand to right-hand as views in FIG. 5.

Although the cutting blades have been provided with their main cutting edges aligned with any plane including the diameter of the disc-like member throughout the illustrated embodiments of the present invention, all of the main cutting edges may be disposed obliquely to the above plane. In this case, a log of timber will also be fed obliquely to said plane, corresponding to the angle included between the main cutting edge and the plane. Thus, the log of timber has its slightly larger corss sectional area to be cut.

I claim:

1. An apparatus for producing chips from logs of timber, comprising a disc-like member having a front face and a rear face, a rotating shaft connected coaxially to a central region of said rear face, said front face being provided with means defining at least one spiral working surface which consists of main and auxiliary oblique surface portions, said spiral working surface extending along a spiral path from adjacent the central region of said disc-like member to the peripheral edge thereof, said main and auxiliary surface portions being inclined relative to one another with a predetermined angle included therebetween, means defining a plurality of openings extending through said disc-like member and spaced from one another along said spiral working surface, cutting blade means disposed in said openings, each of said cutting blade means including a main cutting edge substantially parallel to said main oblique surface portion of said working surface and an auxiliary cutting edge substantially parallel to said auxiliary oblique surface portion of said working surface, said main oblique surface portion being parallel to the rotational axis of said disc-like member.

2. The apparatus as claimed in claim 1 wherein said openings on said disc-like member are provided with shoulders.

3. An apparatus for producing chips from logs of timber, comprising a rotatable disc-like member having a substantially flat front face and a rear face, said front face being perpendicular to the rotational axis of said disc-like member, a rotating shaft connected coaxially to a central region of said disc-like member, said front face being provided with means defining at least one spiral working surface which consists of main and auxiliary oblique surface portions, said spiral working surface extending along a spiral path from adjacent the central region of said disc-like member to the peripheral edge thereof, said main and auxiliary surface portions being inclined relative to said front face of the disc-like member with a predetermined angle included between said main and auxiliary surface portions, said spiral working surface having a plurality of cutting blades spaced from one another therealong, said cutting blades in each 360 degree position of said spiral working surface being radially aligned on radii extending from the center of said disc-like member, each of said cutting blades including a main cutting edge substantially parallel to said main oblique surface portion of said working surface and an auxiliary cutting edge substantially parallel to said auxiliary oblique surface portion of said working surface, each of said cutting blades having a longitudinal axis disposed obliquely relatively to said main cutting edge of said cutting blade, said main cutting edge and said auxiliary cutting edge intersecting one another to make a sharp cutting point, said logs being fed against said front face of said disc-like member in a direction such that the longitudinal axes of the logs are disposed parallel to or at an acute angle relative to the axis of rotation of said disc-like member.

4. A cutting blade for use in an apparatus for producing chips, said blade including a plate-like body which has at one end thereof main and auxiliary cutting edges formed therein with a predetermined angle included therebetween, the opposite end of said body being provided with means for mounting it on said chip producing apparatus, said blade having top and bottom surfaces opposed parallel to each other and side surfaces positioned obliquely relative to the top and bottom surfaces and parallel to each other, one end of said blade being cut obliquely to form said main cutting edge and at the same time cut upwardly and outwardly from the bottom surface thereof to form an inclined surface, the front margin of which is provided with said auxiliary cutting edge positioned angularly with the main cutting edge.

5. The apparatus as claimed in claim 3 wherein said main oblique surface portion comprises a spirally continuous surface.

6. The apparatus according to claim 3 wherein said shaft extends from said rear face of said disc-like member.

7. The apparatus according to claim 3 wherein said shaft extends from said rear and front faces of said disc-like member.

8. The apparatus as claimed in claim 3 further comprising means defining a plurality of openings extending through said disc-like member and spaced from one another along said spiral working surface, said openings each having a longitudinal axis disposed at an acute angle relative to the surface to be cut of said logs being fed, said cutting blade being received within said openings.

9. The apparatus as claimed in claim 3, wherein each of said cutting blades comprises a rectangular plate-like body, said plate-like body having one longitudinal end terminated by a first end oblique surface obliquely disposed relative to said longitudinal axis, said first end oblique surface having an edge which defines said main cutting edge, said plate-like body having a side piece integrally formed with said plate-like body and extending from a side of said plate-like body, said side piece having one longitudinal end terminated by a second end oblique surface obliquely disposed relative to said longitudinal axis, said second end oblique surface having an edge which defines said auxiliary cutting edge.

10. The apparatus as claimed in claim 9, wherein said first and second end oblique surfaces intersect one another to make a sharp cutting point.

11. The apparatus as claimed in claim 9, wherein said first and second end oblique surfaces intersect one another on a line of intersection disposed obliquely relatively to said longitudinal axis.

12. The apparatus as claimed in claim 9, wherein the cross-section of said plate-like body taken along a plane perpendicular to said longitudinal axis has a rectangular configuration and the cross-section of said side piece taken along a plane perpendicular to said longitudinal axis has a triangular configuration.

13. The apparatus as claimed in claim 3, wherein said predetermined angle included between the main and auxiliary surface portions is an obtuse angle and said main cutting edge and said auxiliary cutting edge of said cutting blade means intersect one another at an acute angle.

14. The apparatus as claimed in claim 3, wherein equal number of cutting blades are disposed in each 360 degree portion of said spiral working surface.

15. The apparatus as claimed in claim 8, wherein each of said openings receives a blade-mounting member which supports firmly the corresponding cutting blade, and said blade-mounting member including surfaces aligned with the respective oblique surface portions of said spiral working surface when it is positioned within the opening of said disc-like member.

16. The apparatus as claimed in claim 8 wherein said cutting blades protrude beyond the edges of said openings corresponding to the thickness of the timber material to be cut.

17. The apparatus as claimed in claim 8 in which said openings are circular.

18. An apparatus for producing chips from logs of timer, comprising a disc-like member having a substantially flat front face and a rear face, said front face being perpendicular to the rotational axis of said disc-like member, a rotating shaft connected coaxially to a central region of said disc-like member, said front face being provided with means defining at least one spiral working surface which consists of main and auxiliary oblique surface portions, said spiral working surface extending along a spiral path fron adjacent the central region of said disc-like member to the peripheral edge thereof, said main and auxiliary surface portions being inclined relative to one another with a predetermined angle included therebetween, means defining a plurality of openings extending through said disc-like member and spaced from one another along said spiral working surface, cutting blade means disposed in said openings, each of said cutting blade means including a main cutting edge substantially parallel to said main oblique surface portion of said working surface and an auxiliary cutting edge substantially parallel to said auxiliary oblique surface portion of said working surface, each of said cutting blade means having a longitudinal axis disposed obliquely relatively to said main cutting edge of said cutting blade means, said main cutting edge and said auxiliary cutting edge intersecting one another to make a sharp cutting point, said logs being fed against said front face of said disc-like member in a direction such that the longitudinal axes of the logs are disposed parallel to or at an acute angle relative to the axis of rotation of said disc-like member.

19. The apparatus as claimed in claim 3 wherein said main oblique surface portion comprises an intermittent curved surface.

20. The cutting blade as claimed in claim 19, further including a land portion on said body for reinforcing said auxiliary cutting edge thereof.

* * * * *